US012723858B2

(12) United States Patent
Hart

(10) Patent No.: US 12,723,858 B2
(45) Date of Patent: Sep. 1, 2026

(54) DIRECTED ENERGY IGNITION OF STANDARD PRIMERS

(71) Applicant: MegaWatt Lasers, Inc., Hilton Head Island, SC (US)

(72) Inventor: Benjamin M.W. Hart, Bluffton, SC (US)

(73) Assignee: MegaWatt Lasers, Inc., Hilton Head Island, SC (US)

( * ) Notice: Subject to any disclaimer, the term of this patent is extended or adjusted under 35 U.S.C. 154(b) by 84 days.

(21) Appl. No.: 18/788,399

(22) Filed: Jul. 30, 2024

(65) Prior Publication Data

US 2025/0044067 A1 Feb. 6, 2025

Related U.S. Application Data

(60) Provisional application No. 63/516,648, filed on Jul. 31, 2023.

(51) Int. Cl.

| | |
|---|---|
| ***F42C 19/10*** | (2006.01) |
| ***F41A 19/58*** | (2006.01) |
| ***F41A 19/63*** | (2006.01) |
| ***F42B 3/113*** | (2006.01) |
| ***F42B 5/08*** | (2006.01) |
| ***F42C 19/08*** | (2006.01) |

(52) U.S. Cl.

CPC ..... *F42C 19/10* (2013.01); *F41A 19/58* (2013.01); *F41A 19/63* (2013.01); *F42B 3/113* (2013.01); *F42B 5/08* (2013.01); *F42C 19/0823* (2013.01)

(58) Field of Classification Search

CPC ..... F41A 19/58; F41A 19/63; F42B 3/113; F42B 5/08; F42C 19/10; F42C 19/12; F42C 19/14; F42C 19/0823

USPC ..... 102/201, 202, 204

See application file for complete search history.

(56) References Cited

U.S. PATENT DOCUMENTS

| | | | | |
|---|---|---|---|---|
| 3,631,623 | A * | 1/1972 | Platt | F42B 3/113 42/106 |
| 5,212,339 | A * | 5/1993 | Piltch | F42B 3/113 102/202 |
| 5,301,448 | A * | 4/1994 | Petrick | F42B 5/16 42/84 |
| 6,152,039 | A * | 11/2000 | Lee | F42B 5/08 102/200 |
| 6,499,404 | B1 * | 12/2002 | Kern | F42B 3/113 102/201 |
| 6,805,055 | B1 * | 10/2004 | Jebsen | F41A 19/58 102/205 |
| 7,546,804 | B1 * | 6/2009 | Tartarilla, III | F42B 5/38 102/470 |
| 10,107,607 | B1 * | 10/2018 | Burke | F42C 13/045 |
| 11,543,223 | B2 * | 1/2023 | Callan | F42B 3/113 |
| 2003/0047101 | A1 * | 3/2003 | Folsom | F42B 3/113 102/201 |

* cited by examiner

*Primary Examiner* — James S Bergin

(74) *Attorney, Agent, or Firm* — Douglas L. Lineberry

(57) ABSTRACT

Described herein are systems and methods for igniting ammunition via directed energy upon standard primers designed for mechanical or electrical ignition, wherein ignition is produced by methods originating from outside of the cartridge and without modification to the primer, cartridge, or ammunition wherein the cartridge can be fired using either the outlined methods of a directed energy pulse or a traditional mechanical or electrical method.

20 Claims, 3 Drawing Sheets

DIRECTED ENERGY IGNITION OF STANDARD PRIMERS

TECHNICAL FIELD

The subject matter disclosed herein is generally directed to systems and methods for igniting ammunition through directed energy with standard primers designed for mechanical or electrical ignition, wherein ignition is initiated by methods outside of the cartridge and without modification to the cartridge wherein the cartridge can be fired using either these optical systems and methods or traditional ignition methods.

BACKGROUND

Current mechanical firing systems for weapons platforms, whether vehicle mounted or handheld, involve significant vibrations and generate inertial delay. Attempts to remedy these drawbacks via employing laser ignition systems have been designed to reduce the number of moving parts in a weapon ignition system, as well as remove inertial delay. However, these systems have created their own, unique servicing/mechanical issues for the weapon platforms upon which they are installed, such as requiring additional maintenance and servicing of specialized parts, in addition to requiring reconfiguration of existing ammunition primers to accommodate laser ignition systems.

For example, U.S. Pat. No. 3,685,392, Platt, discloses a device for firing ammunition, which has a chamber in which the propellant is placed, the chamber communicating with a barrel or guide through which is the projectile or missile is propelled by the propellant when it is ignited, there being a window through which laser radiation can be directed onto the propellant in the chamber, the window pressure sealing the chamber when the chamber is closed. (Abstract.)

Further, U.S. Pat. No. 9,273,942, Burke et al., provides an ammunition cartridge for a gun that is optically initiated by a mechanism wholly within the cartridge case itself. The case has as optical primer initiation means producing light fluence to ignite a primer, which ignited primer may in turn ignite into a flashtube, and which ignited flashtube may in turn ignite a bed of propellant in said cartridge, see FIG. 2. The optical primer initiation means may be an LED, a laser diode, a VCSEL, or some other light emitting device in general. The cartridge optically initiated primer package is so sized and made electrically and mechanically seamlessly physically compatible with current ammunition cartridges such that these new cartridges are completely interchangeable. If the cartridge primer initiation means is of a percussion type, the cartridge is adapted to include an in-line piezoelectric crystal so that electrical power will be generated when the cartridge assembly is struck by a firing pin during percussion type operations; the power is then used to initiate the light emitting device. (Abstract.)

Other attempts include:

- U.S. Pat. No. 3,631,623, which is similar to U.S. Pat. No. 3,685,392 in that it incorporates a window instead of the usual primer;
- U.S. Pat. No. 10,641,572 utilizes special energetic material that is sensitive to microwave radiation whereas our approach utilizes standard primers and propellant;
- U.S. Pat. No. 10,969,206 utilizes specialized RF igniters;
- US Pat. Pub. 2011/0167700 utilizes a window where a primer is normally placed;
- WO 1995011420 uses an optical window in place of the conventional primer;

- DE 3810048A1 uses a special primer or window in place of the primer;
- US Pat. Pub. 2003/0047101 uses a window;
- U.S. Pat. No. 10,107,607 utilizes a special primer;
- U.S. Pat. No. 10,107,607 (1971) utilizes an electromagnetic window;
- WO 2002021068 utilizes a window;
- U.S. Pat. No. 5,148,748 involves heating the end of the cartridge and heat transfer to the energetic material, but it utilizes a special primer and not a conventional primer;
- apps.dtic.mil/sti/pdfs/ADA368860.pdf-uses a sapphire window; and
- U.S. Pat. No. 7,546,804 describes a modified Modular Artillery Charge (MAC) used in the Crusader or NLOS-C howitzers both of which use sapphire windows.

Accordingly, it is an object of the present disclosure to provide an improved laser ignition system for ammunition for use with standard/existing ammunition primers without requiring modification to the cartridge, while also allowing for firing of ammunition via traditional methods as well.

Citation or identification of any document in this application is not an admission that such a document is available as prior art to the present disclosure.

SUMMARY

The above objectives are accomplished according to the present disclosure by providing in one instance, an improved method for percussion primer ignition. The method may include applying at least one form of directed energy via at least one firing system to at least one percussion primer contained in at least one ammunition cartridge; wherein the at least one form of directed energy applied to the at least one percussion primer causes the at least one percussion primer in the at least one ammunition cartridge to ignite; and wherein no mechanical contact with the at least one percussion primer nor electrical contact with the at least one percussion primer occurs. Further, the method may include configuring the at least one firing system to have no moving components as contained in a mechanical ignition system. Additionally, the method may include initiating multiple primer initiation attempts with no manual intervention with respect to the at least one percussion primer. Still yet, the at least one form of directed energy may include at least one electromagnetic wave selected from the group of radio waves, infrared radiation, visible light, ultraviolet radiation, X-rays, gamma-rays and/or combinations of the above. Moreover, the at least one form of directed energy may have a functional wavelength within a range of from 10 nm to 1 mm. Yet further, the at least one form of directed energy may comprise a laser. Still further yet, the laser may operate at a wavelength between 900 and 1064 nm. Again still, the at least one ammunition cartridge may not be modified to receive the at least one form of directed energy and can be ignited by traditional ignition methods. Furthermore, no window or light path may be configured into that at least one ammunition cartridge.

In another instance, the current disclosure provides an improved system for percussion primer ignition. The system may include a firing system comprising at least one pump chamber; at least one doped rod; and at least one spherical lens, wherein the firing system may generate at least one form of directed energy via the at least one pump chamber and the at least one doped rod and may apply the at least one form of directed energy to at least one percussion primer in at least one ammunition cartridge via the at least one spherical lens thereby causing the at least one percussion primer in the at least one ammunition cartridge to ignite. Further yet, the system may include configuring the at least one firing system to have no moving components as contained in a mechanical ignition system. Yet again, the system may include initiating multiple primer initiation attempts with no manual intervention with respect to the at least one percussion primer. Yet furthermore, the at least one form of directed energy may include at least one electromagnetic wave selected from the group of radio waves, infrared radiation, visible light, ultraviolet radiation, X-rays, gamma-rays and/or combinations of the above. Again still, the at least one form of directed energy may have a functional wavelength within a range of from 10 nm to 1 mm. Still further yet, the at least one form of directed energy may comprise a laser. Furthermore, the laser may operate at a wavelength between 900 nm and 1064 nm. In addition, the at least one ammunition cartridge may not be modified to receive the at least one form of directed energy and can be ignited by traditional ignition methods. Still yet, no window or light path may be configured into that at least one ammunition cartridge.

The current disclosure also provides a method for retrofitting an existing weapon platform to provide improved percussion primer ignition. This method may include introducing a firing system into the existing weapon platform that includes at least one pump chamber, at least one doped rod; and at least one spherical lens; wherein the firing system may generate at least one form of directed energy via the at least one pump chamber and the at least one doped rod and may apply the at least one form of directed energy to at least one percussion primer in at least one ammunition cartridge via the at least one spherical lens thereby causing the at least one percussion primer in the at least one ammunition cartridge to ignite. Further, the at least one form of directed energy may include at least one electromagnetic wave selected from the group of radio waves, infrared radiation, visible light, ultraviolet radiation, X-rays, gamma-rays and/or combinations of the above.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which.

Figure 1:
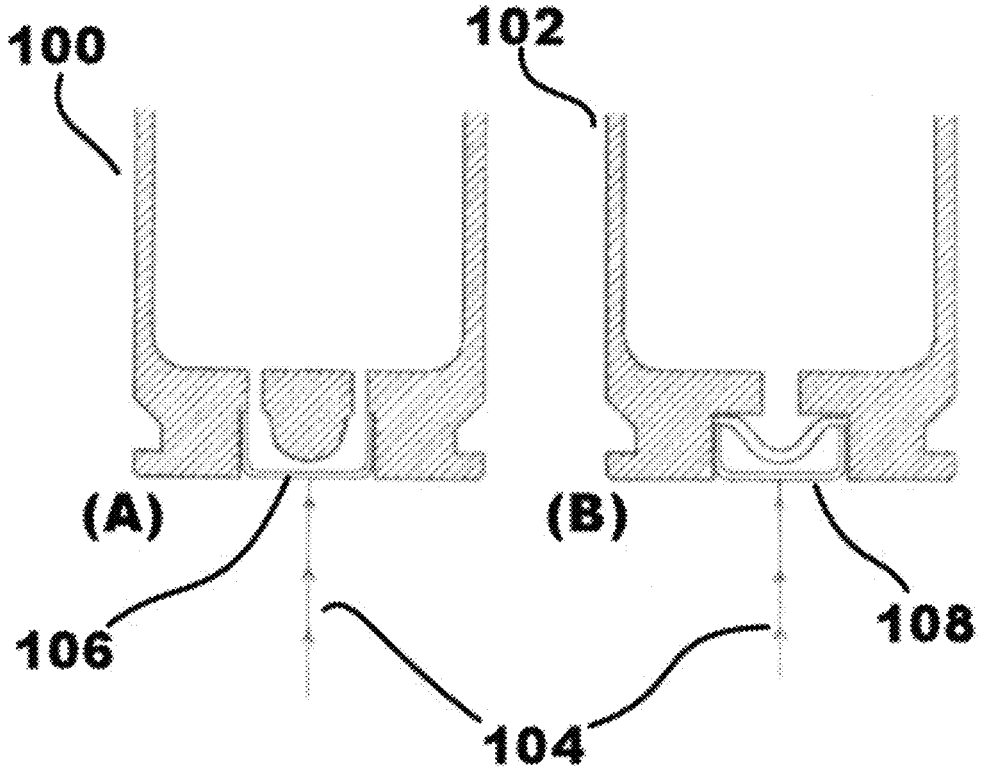
FIG. 1 shows one embodiment of the current disclosure employed with Berdan and Boxer primers.

The figures herein are for illustrative purposes only and are not necessarily drawn to scale.

Definitions

The following is a list of definitions which are used to describe embodiments, background information, and parameters of the present disclosure. While these definitions are described in connection with the present disclosure, they are not intended to limit embodiments of the present disclosure to this description. On the contrary, the intent is to cover all alternatives, modifications, and equivalents included within the spirit and scope of embodiments of the present disclosure. The following definitions are put forth so as to provide those of ordinary skill in the art with a complete disclosure and description of how to perform the methods and use the probes disclosed and claimed herein.

Berdan a primer as defined by U.S. Pat. No. 82,587A. One example of conventional primers.

Boxer a primer as defined by U.S. Pat. No. 91,818A. One example of conventional primers.

Caliber—in small arms—the diameter of the bore measured from land to land, usually expressed in hundredths of an inch (e.g., .22 cal) or in millimeters (9 mm). In ammunition, a naming system that indicates cartridge dimensions as well as bore diameters and can be the same as the Firearm caliber.

Cannon a large caliber gun fired from a carriage or fixed mount and with a bore diameter of at least 20 mm.

Cartridge a unit of ammunition, made up of a cartridge case, primer, propellant, and bullet.

Cartridge Case a casing containing a primer, propellant, and a bullet or shot for small arms or an explosive charge for blasting.

Centerfire the cartridge contains the primer in the center of the case head or base, where it can be struck by the firing pin of the action. For example, this includes the Boxer and Berdan primers.

Conventional Primer widely available percussion or possibly electrical primers including both centerfire and rimfire styles.

Directed Energy the presence of a controlled electromagnetic wave focused upon the primer.

Ignition the action of starting the propellant's combustion process.

Initiation—with respect to primers—to affect the primer in a manner that causes ignition of the internal primer mixture.

Laser a device that generates an intense beam of coherent monochromatic light (or other electromagnetic radiation) by stimulated emission of photons from excited atoms or molecules.

Primer is the chemical and/or device responsible for initiating the propellant's combustion.

Primer (Percussion): An explosive substance that ignites when struck to detonate the powder in a cartridge. "centerfire" cartridges have a primer mixture in a 'cup' in the middle of the base of the cartridge case.

Projectile a missile designed to be fired from a rocket or gun

Propellant the charge of explosive used to propel the projectile.

Rimfire relating to or denoting guns whose cartridges have the primer around the edge of the base.

Round a military term for a cartridge.

DETAILED DESCRIPTION OF THE EXAMPLE EMBODIMENTS

Before the present disclosure is described in greater detail, it is to be understood that this disclosure is not limited to particular embodiments described, and as such may vary. It is also to be understood that the terminology used herein is for the purpose of describing particular embodiments only and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth, hundredth, thousandth, etc., of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a", "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g. given data set, art accepted standard, and/or with e.g. a given confidence interval (e.g. 90%, 95%, or more confidence interval from the mean), such as variations of +/−10% or less, +/−5% or less, +/−1% or less, and +/−0.1% or less of and from the specified value, insofar such variations are appropriate to perform in the disclosure. As used herein, the terms "about,"

"approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used interchangeably herein, the terms "sufficient" and "effective," can refer to an amount (e.g. mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g. a web interface.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the methods and systems described herein can be presented as a combination kit. As used herein, the terms "combination kit" or "kit of parts" refers to the methods and systems and any additional components that are used to package, sell, market, deliver, install, and/or provide a combination of the methods and systems or a single element of the methods and systems, such as the ignition system, contained therein. Such additional components include, but are not limited to packaging, components, parts, and the like. When one or more of the methods and systems described herein or a combination thereof (e.g., parts contained in the kit are provided simultaneously, the combination kit can contain the methods and systems in a single combination, such as a primer ignition system or in separate combinations breaking the primer ignition system into discrete sub-units, including items protected via other patents/patent applications, etc. When the methods and systems described herein or a combination thereof and/or kit components are not provided simultaneously, the combination kit can contain each agent or other component in separate packing or sub-units. The separate kit components can be contained in a single package or in separate packages within the kit.

In some embodiments, the combination kit also includes instructions printed on or otherwise contained in a tangible medium of expression. The instructions can provide information regarding the methods and systems, maintenance instructions, safety information regarding the methods and systems, information regarding applications, instructions for assembly and retrofitting, and/or indications for use contained therein. In some embodiments, the instructions can provide directions and protocols for installing, assembling, retrofitting and/or otherwise employing the methods and systems described herein with an existing firearm and/or weapons platform. In some embodiments, the instructions can provide one or more embodiments of the methods and systems, such as any of the methods and systems described in greater detail elsewhere herein.

The current disclosure provides systems and methods by which standard primers, e.g., those contained in a cartridge, designed for mechanical or electrical ignition are ignited or initiated via directed energy. Ignition is produced by optical methods outside of the cartridge and without modification to the cartridge. In addition, the cartridge can be fired using either this optical method or traditional methods.

FIG. 1 shows at (A) a standard Berdan primer configuration 100 and at (B) a standard Boxer primer configuration 102, the two most widely used primer configurations worldwide. Boxer primers are the most popular type of primer in the United States, named after their inventor, Colonel Edward Boxer. Boxer primers have a cup that is filled with an impact-sensitive compound. An anvil is located in the center of the cup. When the firing pin strikes the primer, it ignites the compound and causes a small explosion. This explosion creates a hot gas that ignites the powder in the cartridge case. Berdan primers were invented by Colonel Hiram Berdan. These primers have two flash holes instead of a single hole like Boxer primers. There is also no anvil in Berdan primers; instead, there is a small cup that contains the primer compound. When the firing pin strikes the primer, it ignites the compound and creates a small explosion. This explosion creates a hot gas that ignites the powder in the cartridge case. The current disclosure will function with Centerfire primers, such as the Boxer and Berdan primers, as well as Rimfire primers wherein the firing pin of the weapon strikes the rim of the cartridge base to ignite a primer, while in centerfire, the firing pin strikes a center primer, see FIG. 1. In FIG. 1, Laser beam 104 contacts exterior 106 of the Berdan percussion primer 100 and exterior 108 of Boxer percussion primer 102 to ignite the primer compounds contained therein (not shown). Energy imparted from laser 104 ignites the primer compounds.

The current disclosure provides various novel features. First, the percussion primer is ignited/initiated via at least one firing system without mechanical or electrical contact. This eliminates vibrations and inertial delay associated with the moving components in a mechanical ignition systems. Ignition via directed energy allows shorter response intervals and more consistent response times. There is no additional movement otherwise associated with a mechanical ignition sequence, which increases the precision of the system. Another feature is that the current system also allows for multiple primer initiation attempts in a weapons platform without manual intervention. For gas operated systems, such as the M2 browning, an increase in reliability can be expected. Typically, a firing pin or striker is the portion of the firing mechanism of a firearm that impacts the primer in the base of a cartridge and causes it to fire. Here, laser 104 takes the place of a firing pin and allows for multiple ignition attempts of a cartridge by simply reinitiating laser 104 without requiring breakdown of the weapons platform to remove a non-firing cartridge and also without breakdown, manual cycling, or otherwise resetting the firing pin.

The current disclosure also provides for optical ignition of a cartridge or ammunition without requiring a window or light path. Existing systems utilize a modified primer specifically designed for laser ignition. For instance, the fire control system for the Crusader 155 mm cannon was designed for laser ignition. Optical ignition was facilitated by a laser firing through a window in the breech directly into the specially designed base pad of the propelling charge. This increased the safety of the system by allowing for multiple laser ignitions and higher energy ignitions in the event of a misfire. This system also reduced resupply requirements and eliminated environmental waste by replacing traditional, single use primary igniters.

Figure 2:
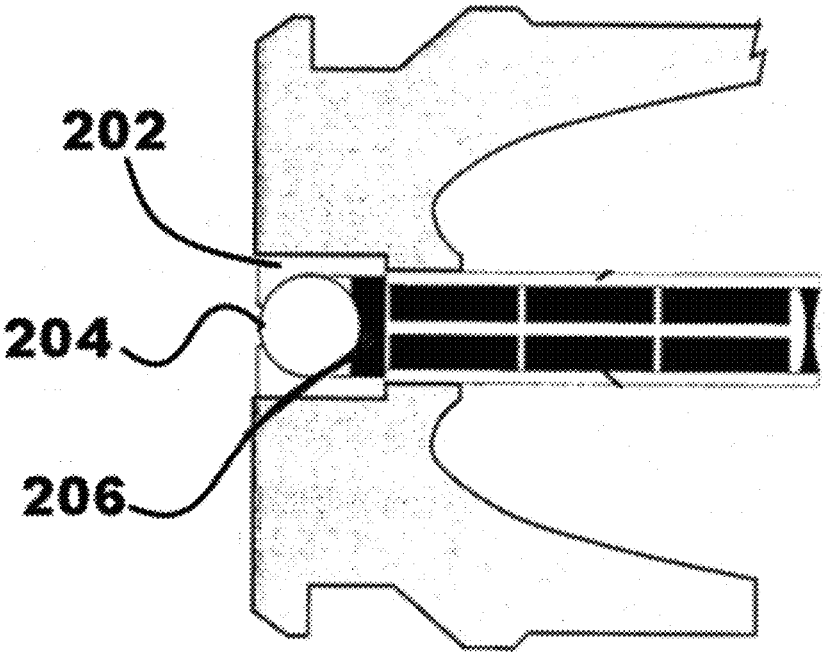
FIG. 2 PRIOR ART
FIG. 2 shows a diagram of a 30 mm round with spherical window for laser ignition for existing laser existing systems.

Later, laser ignition was also developed for medium caliber systems, namely the M230 30 mm chain gun used with Apache helicopters. In this case, the primer of the 30 mm cartridge was replaced with a spherical window, see FIG. 2. FIG. 2 shows a specifically formed window primer 202 surrounding a ball window 204, which is in contact with igniter material 206. This system requires extensive retooling of ammunition configurations and is not functional with existing conventional ammunition. Laser ignition was proposed to reduce electromagnetic interference inherent in the electrical ignition systems currently fielded. Moving on to small caliber arms, an example would be the Voere laser bolt system. This system was designed to improve precision due to fewer moving parts and vibrations.

The current disclosure improves these previously designed systems as no modification to the ammunition is required. There is an inherent benefit in standardized ammunition between traditional and laser firing systems. Additionally, non-standardized laser ignition methods require additional field maintenance such as window cleaning. The current disclosure systems and methods minimize servicing of, and eliminates the need for, specialized primers.

The disclosure also provides methods for igniting ammunition via directed energy utilizing standard primers designed for mechanical or electrical ignition, wherein ignition is produced by methods outside of the cartridge and without modification to the cartridge wherein the cartridge can be fired using either these optical systems and methods or traditional ignition methods.

In the context of this disclosure, Directed Energy is defined as electromagnetic waves including radio waves, infrared radiation, visible light, ultraviolet radiation, X-rays and gamma-rays, and/or combinations of the above, that may be incident upon a target. That is to say any wave in the range from 1 μm to 100 mm wavelength. The functional wavelength for this specific application is thought to be the optical spectrum, i.e. those functioning within the 10 nm to 1 mm range. The optical range insights the ability for multiple different methods of focusing the light upon the primer.

The source of the electromagnetic radiation may be a light source such as LED, or a LASER. The most popular of these devices operate in the visible spectrum of 400-700 nm and the infrared spectrum of 700-11,000 nm. The source may also be a semiconductor laser with a wavelength of 300-1100 nm.

With respect to another embodiment of the current disclosure, one possibility is to use an optically pumped solid-state laser. Alternatively, one could use a semiconductor source such as an LED, Laser Diode, or VCSEL. It may not be necessary to use a lens. It is possible the direct output of the laser could be used without concentration or focusing. Additionally, there are other methods of concentrating or focusing the directed energy other than "spherical" lenses that are known to those of skill in the art and hereby incorporated.

While the current disclosure provides a method to use standard unmodified ammunition, it can also use ammunition specifically designed for optical ignition. i.e. the laser can be used to ignite either traditional or optically primed ammunition. This allows for the design of a new system that can use the existing inventory of traditionally primed ammunition. For example, if a weapons system is designed to use optically primed ammunition, this method would allow you to inherently use either optical ammunition or traditionally primed ammunition within the system.

In addition, the current disclosure provides methods for retrofitting an existing weapon or weapon platform. The firing system of the current disclosure may be introduced to an existing weapon or weapon platform to ignite ammunition via directed energy utilizing standard primers designed for mechanical or electrical ignition. Ignition is produced as described herein by impinging the primer with energy originating from outside of the cartridge and without modification to the cartridge wherein the cartridge can be fired using either these directed energy systems and methods or traditional ignition methods.

Further embodiments are illustrated in the following Examples which are given for illustrative purposes only and are not intended to limit the scope of the disclosure.

EXAMPLE

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure. The following examples are put forth so as to provide those of ordinary skill in the art with a complete disclosure and description of how to perform the methods and use the probes disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Figure 3:
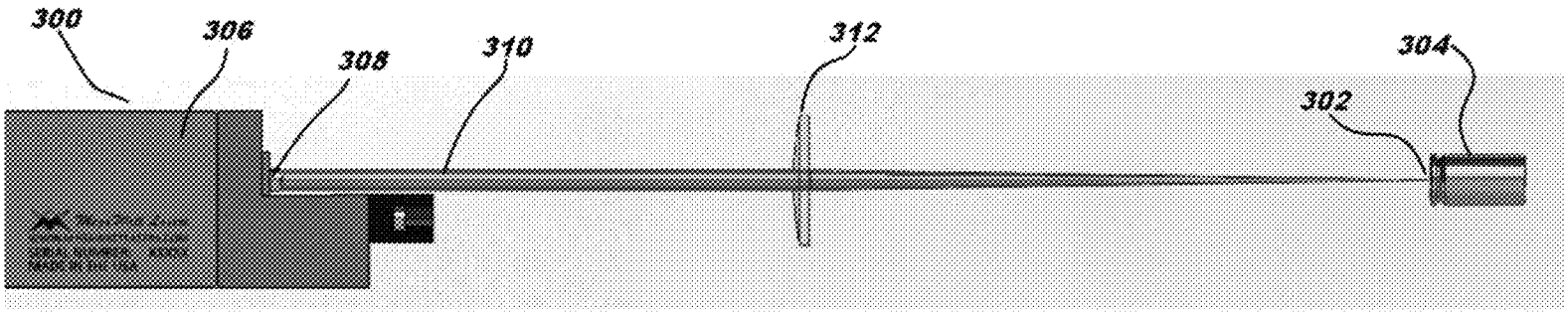
FIG. 3 shows an illustration of one possible testing setup for the current disclosure.

FIG. 3 shows one embodiment of a testing setup 300 of the current disclosure. In FIG. 3, a Winchester small pistol primer 302 in a 9 mm Largo case 304 is ignited by a 7X125F5 pump chamber 306 with a Neodymium doped Yttrium Aluminum Garnet (Nd:YAG) rod 308. Ignition occurred as a single 4.28 J pulse 310 with a width of 1000 μs. The beam was focused through a plano-convex spherical lens 312 with the Winchester small pistol primer 302 located at roughly the focal point. This is just one example of a setup for achieving laser ignition of a percussion primer. It can be achieved at other wavelengths, pulse energies, pulse widths, repetition rates, with other optical components, and in other configurations. Further, the laser does not need to be a solid-state and an infinite number of configurations could be used. It is expected, that with experimentation, the results detailed here will be significantly optimized. Further, a pump chamber with a laser operating at 650-3000 nm may be employed.

Per the current disclosure, one possible embodiment is a laser that is concentrated upon the primer. Such as the use of an Nd:YAG laser as explained supra, which operates at a wavelength of approximately 1064 nm. Another potential example is a semiconductor laser operating at approximately 900 nm. With the invention and improvements upon other optically powered devices, it is determined that a functional embodiment could be achieved with other sources.

Further, a very simple example would be a direct diode laser with either minimal or no optics between it and the primer. Another example might be a fiber coupled laser diode. In this embodiment, the diode laser could be mounted in a location remote from the actual weapon. In a broad example, all that would be needed is an electromagnetic radiation generator.

For this disclosure, the term directed energy does not include electrical discharges, mechanically moving objects, or other similar methods. Directed energy is also defined as the energy occurring outside of the system, namely the energy which causes a transfer of kinetic energy which therefore initiates the primer. We embrace the firing method of percussive, thermal, penetrative and acoustic energy; however, other devices and wavelengths may cause ignition. Because the embodiment of this system can be optimized for different wavelengths, the pulse width, output power and pulse shape can also be optimized.

REFERENCES

U.S. Pat. No. 3,685,392A—Laser ignition system

U.S. Pat. No. 9,273,942B1—Disposable, miniature internal optical ignition source for ammunition application U.S. Pat. No. 3,177,651A—Laser Ignition RU2344363C2—Ammunition with electrical ignition (versions) and shooting device for it U.S. Pat. No. 6,332,403B1—Ammunition Cartridge with Electrically Ignited Propellant Charge US20070107591A1—Electronic Ignition System for a Firearm U.S. Pat. No. 9,625,242B1—Igniter for Modular Artillery Charge System U.S. Pat. No. 4,386,567A—Combination Percussion-Electric Primer U.S. Pat. No. 6,212,989B1—High pressure, high temperature window assembly and method of making the same U.S. Pat. No. 9,909,847B1—Disposable, miniature internal optical ignition source U.S. Pat. No. 10,859,358B1—Radio frequency igniter U.S. Pat. No. 9,625,242B1—Igniter for modular artillery charge system U.S. Pat. No. 10,627,200B1—Disposable, miniature internal optical ignition source U.S. Pat. No. 6,212,989B1—High pressure, high temperature window assembly and method of making the same US20110167700A1—Light activated cartridge and gun for firing same U.S. Pat. No. 7,270,044B1—Plasma firing mechanism and method for firing ammunition John M. Hirlinger, Gregory C. Burke, Richard A. Beyer, Scott J. Hamlin, and Thomas Doris "A laser ignition system for the M230 cannon", Proc. SPIE 5871, Optical Technologies for Arming, Safing, Fuzing, and Firing, 587101 (18-8-2005); https://doi.org/10.1117/12.617345

Scott J. Hamlin, Richard A. Beyer, Gregory C. Burke, John M. Hirlinger, James Martin, and Daniel L. Rhonehouse "Laser sources for medium caliber cannon ignition", Proc. SPIE 5871, Optical Technologies for Arming, Safing, Fuzing, and Firing, 587102 (18 Aug. 2005); https://doi.org/10.1117/12.618194

Richard A. Beyer "Laser ignition for artillery cannon", Proc. SPIE 5871, Optical Technologies for Arming, Safing, Fuzing, and Firing, 58710A (19 Aug. 2005); https://doi.org/10.1117/12.617323

Stephen L. Howard, Jeffrey B. Morris, Richard A. Beyer, Scott J. Hamlin, James Martin, Gregory C. Burke, and Thomas Doris "Laser initiation thresholds of a 'green' aluminum/molybdenum-trioxide metastable intermolecular composite and other pyrotechnics", Proc. SPIE 5871, Optical Technologies for Arming, Safing, Fuzing, and Firing, 58710B (18 Aug. 2005); https://doi.org/10.1117/12.614508

Christopher R. Hardy, Michael J. Myers, John D. Myers, Robert L. Gadson, Joseph Leone, Josiah W. Fay, and Kevin Boyd "Nd:YAG breech mounted laser igniter", Proc. SPIE 5871, Optical Technologies for Arming, Safing, Fuzing, and Firing, 58710L (19 Aug. 2005); https://doi.org/10.1117/12.621246

Cartridges of the World 11th Edition, by Frank C. Barnes, edited by Stan Skinner, Gun Digest Books, 2006, ISBN 0-89689-297-2.

Various modifications and variations of the described methods and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An improved method for percussion primer ignition comprising:

applying at least one form of directed energy via at least one firing system to at least one percussion primer contained in at least one ammunition cartridge;

wherein the at least one form of directed energy applied to the at least one percussion primer causes the at least one percussion primer in the at least one ammunition cartridge to ignite; and wherein no mechanical contact with the at least one percussion primer nor electrical contact with the at least one percussion primer occurs.

2. The method for percussion primer ignition of claim 1, further comprising configuring the at least one firing system to have no moving components as contained in a mechanical ignition system.

3. The method for percussion primer ignition of claim 1, further comprising initiating multiple primer initiation attempts with no manual intervention with respect to the at least one percussion primer.

4. The method for percussion primer ignition of claim 1, further comprising wherein the at least one form of directed energy includes at least one electromagnetic wave selected from the group of radio waves, infrared radiation, visible light, ultraviolet radiation, X-rays, gamma-rays and/or combinations of the above.

5. The method for percussion primer ignition of claim 4, further comprising wherein the at least one form of directed energy has a functional wavelength within a range of from 10 nm to 1 mm.

6. The method for percussion primer ignition of claim 1, further comprising wherein the at least one form of directed energy comprises a laser.

7. The method for percussion primer ignition of claim 6, further comprising wherein the laser operates at a wavelength between 900 and 1064 nm.

8. The method for percussion primer ignition of claim 1, further comprising wherein the at least one ammunition cartridge is not modified to receive the at least one form of directed energy and can be ignited by traditional ignition methods.

9. The method for percussion primer ignition of claim 1, further comprising wherein no window or light path is configured into that at least one ammunition cartridge.

10. An improved system for percussion primer ignition comprising;

a firing system comprising at least one pump chamber;

at least one doped rod; and at least one spherical lens;

wherein the firing system generates at least one form of directed energy via the at least one pump chamber and the at least one doped rod and applies the at least one form of directed energy to at least one percussion primer in at least one ammunition cartridge via the at least one spherical lens thereby causing the at least one percussion primer in the at least one ammunition cartridge to ignite.

11. The improved system for percussion primer ignition of claim 10, further comprising configuring the at least one firing system to have no moving components as contained in a mechanical ignition system.

12. The improved system for percussion primer ignition of claim 10, further comprising initiating multiple primer initiation attempts with no manual intervention with respect to the at least one percussion primer.

13. The improved system for percussion primer ignition of claim 10, further comprising wherein the at least one form of directed energy includes at least one electromagnetic wave selected from the group of radio waves, infrared radiation, visible light, ultraviolet radiation, X-rays, gamma-rays and/or combinations of the above.

14. The improved system for percussion primer ignition of claim 13, further comprising wherein the at least one form of directed energy has a functional wavelength within a range of from 10 nm to 1 mm.

15. The improved system for percussion primer ignition of claim 10, further comprising wherein the at least one form of directed energy comprises a laser.

16. The improved system for percussion primer ignition of claim 15, further comprising wherein the laser operates at a wavelength between 900 nm and 3000 nm.

17. The improved system for percussion primer ignition of claim 10, further comprising wherein the at least one ammunition cartridge is not modified to receive the at least one form of directed energy and can be ignited by traditional ignition methods.

18. The improved system for percussion primer ignition of claim 10, further comprising wherein no window or light path is configured into that at least one ammunition cartridge.

19. A method for retrofitting an existing weapon platform to provide improved percussion primer ignition comprising;

introducing a firing system into the existing weapon platform that includes:

at least one pump chamber;

at least one doped rod; and at least one spherical lens;

wherein the firing system generates at least one form of directed energy via the at least one pump chamber and the at least one doped rod and applies the at least one form of directed energy to at least one percussion primer in at least one ammunition cartridge via the at least one spherical lens thereby causing the at least one percussion primer in the at least one ammunition cartridge to ignite.

20. The method for retrofitting an existing weapon platform to provide improved percussion primer ignition of claim 19, further comprising wherein the at least one form of directed energy includes at least one electromagnetic wave selected from the group of radio waves, infrared radiation, visible light, ultraviolet radiation, X-rays, gamma-rays and/or combinations of the above.

* * * * *